US005154299A

United States Patent [19]

Hwang

[11] Patent Number: 5,154,299

[45] Date of Patent: Oct. 13, 1992

[54] SUPER-THIN TYPE FILE HOLDER

[76] Inventor: Shih-Ming Hwang, No. 11, Alley 12, Lane 7, Ching-Tyan St., Taipei, Taiwan

[21] Appl. No.: 769,239

[22] Filed: Oct. 1, 1991

[51] Int. Cl.[5] ..... B42F 17/06

[52] U.S. Cl. ..... 211/11; 211/41; 211/43; 211/184

[58] Field of Search ..... 211/11, 40, 41, 43, 211/189, 184, 42

[56] References Cited

U.S. PATENT DOCUMENTS

| | | | |
|---|---|---|---|
| 1,429,076 | 9/1922 | Helsley | 211/40 X |
| 3,300,057 | 1/1967 | Wheaton | 211/184 |
| 3,905,484 | 9/1975 | Dean et al. | 211/184 |
| 3,909,088 | 9/1975 | Dennehey et al. | 211/41 X |
| 4,278,174 | 7/1981 | Le Blanc | 211/40 |
| 4,512,480 | 4/1985 | Evensen | 211/11 |
| 4,525,882 | 7/1985 | Stenberg | 211/184 X |
| 4,759,449 | 7/1988 | Gold | 211/185 X |

*Primary Examiner*—Blair M. Johnson
*Assistant Examiner*—Derek J. Berger
*Attorney, Agent, or Firm*—Morton J. Rosenberg; David I. Klein

[57] ABSTRACT

A super-thin type file holder comprising (a) a base having a plurality of dovetail slots with longitudinal grooves and positioning tabs, and (b) a plurality of partitions each having a footing board with positioning notches to seize the positioning tabs so that the respective partitions can be positioned at any desired dovetail slot to meet different requirements.

3 Claims, 4 Drawing Sheets

SUPER-THIN TYPE FILE HOLDER

BACKGROUND OF THE INVENTION

The present invention provides a super-thin type file holder, particularly a film holder which is easy to pack, assemble and disassemble.

Conventionally a file holder is in the form of a box to hold documents, and it may be composed of a plurality of boxes if there are many documents to be held. Therefore, it does not only occupy a considerably large space on the table where it is placed, but it means a waste of space within such boxes, and such a file holder is not easy to pack, assemble, disassemble and move.

In view of such defects, years of experiences in making file holders have enabled the inventor to design a super-thin type file holder.

According to the present invention, the super-thin type file holder has the following features:

(1) The file holder can be split into several pieces of boards, thereby minimizing space to facilitate packing and transportation, and reducing freight.

(2) Only a few partitions have to be erected to complete assembly, and the number of erected partitions can be changed to meet individual requirement.

(3) The holder can be positioned in any direction and it eliminates the defect of the conventional file holder which has a fixed structure.

(4) Any partition can be moved to facilitate removal of documents.

(5) Positioning tabs are used for firmly fitting the partitions to the base.

SUMMARY OF THE INVENTION

The main object of the present invention is to provide a super-thin type file holder comprising (a) a base having a plurality of dovetail slots with longitudinal grooves and positioning tabs, and (b) a plurality of partitions each having a footing board with positioning notches to seize the positioning tabs so that the respective partitions can be positioned at any desired dovetail slot to meet different requirements.

Another object of the present invention is to (a) provide a super-thin type film holder which is easy to assemble and disassemble, and (b) occupy minimum space of package when the file holder is packed.

DETAILED DESCRIPTION OF THE PREFERRED EMBODIMENT

Figure 1:
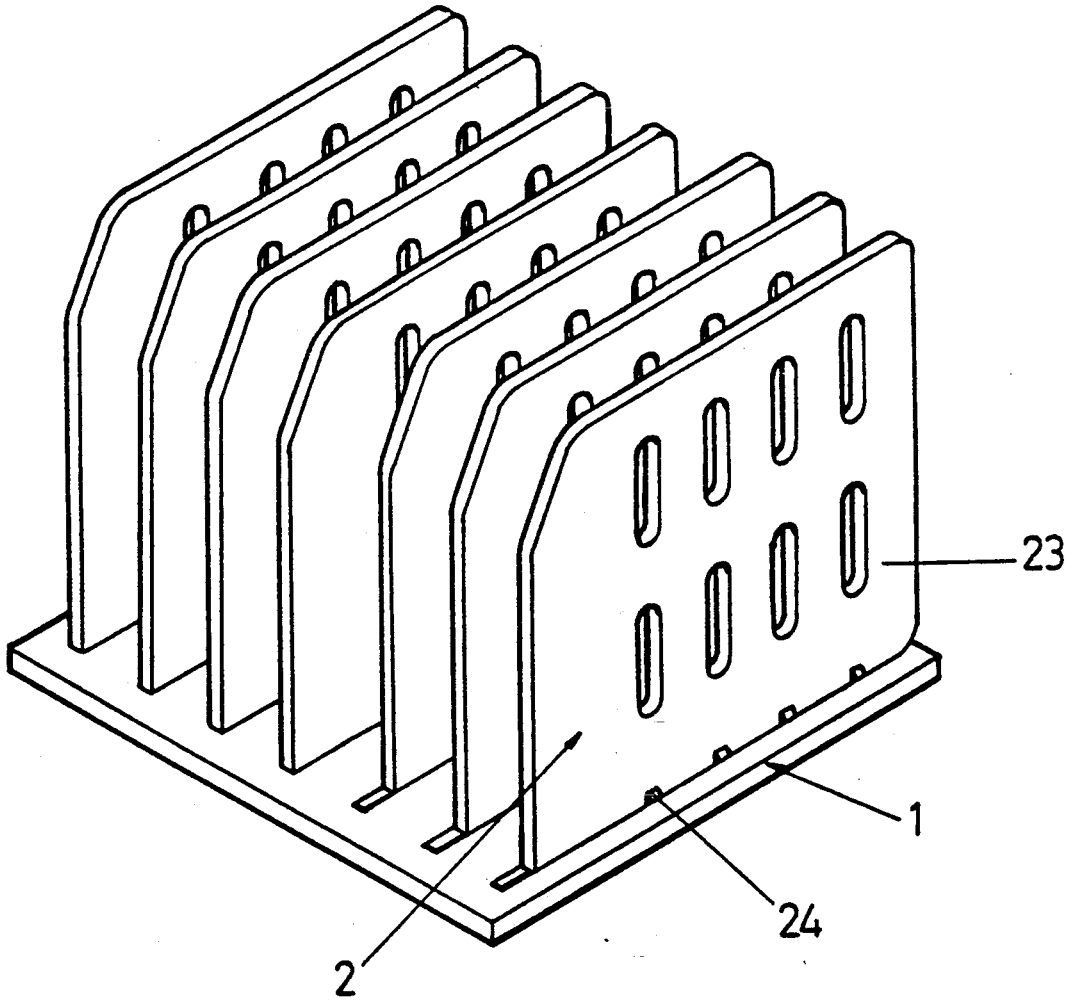
FIG. 1 is a perspective view of a super-thin type file holder according to the present invention.
Figure 3:
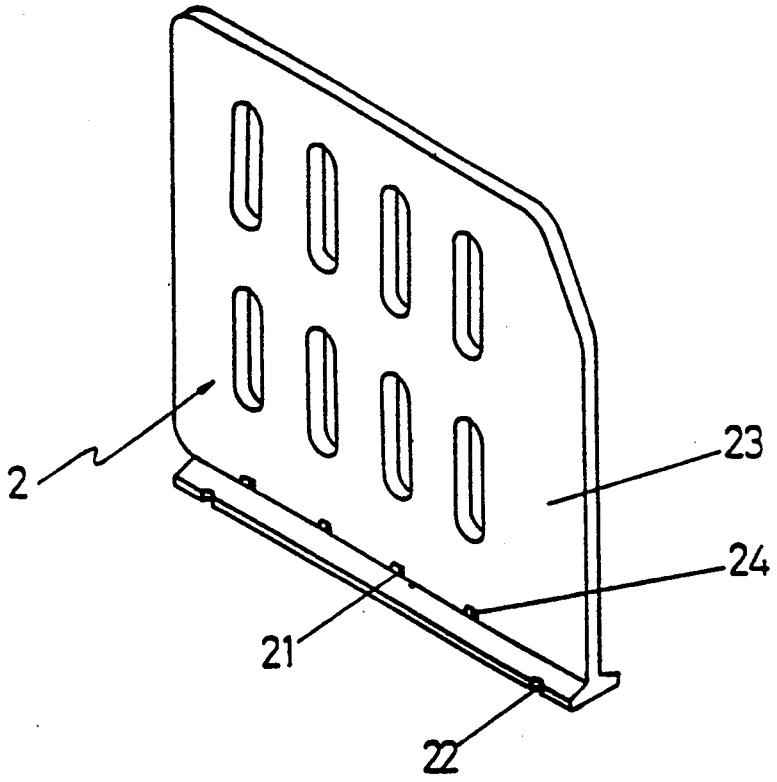
FIG. 3 is a perspective view of a partition according to the present invention.
Figure 2:
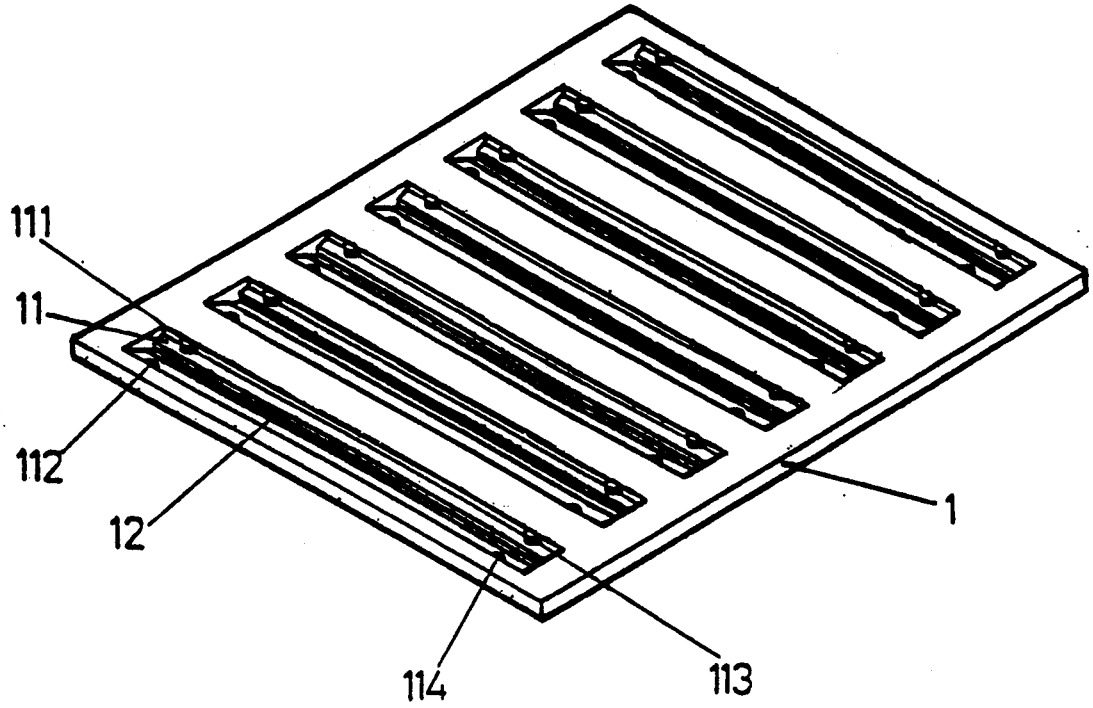
FIG. 2 is a perspective view of a base according to the present invention.
Figure 6:
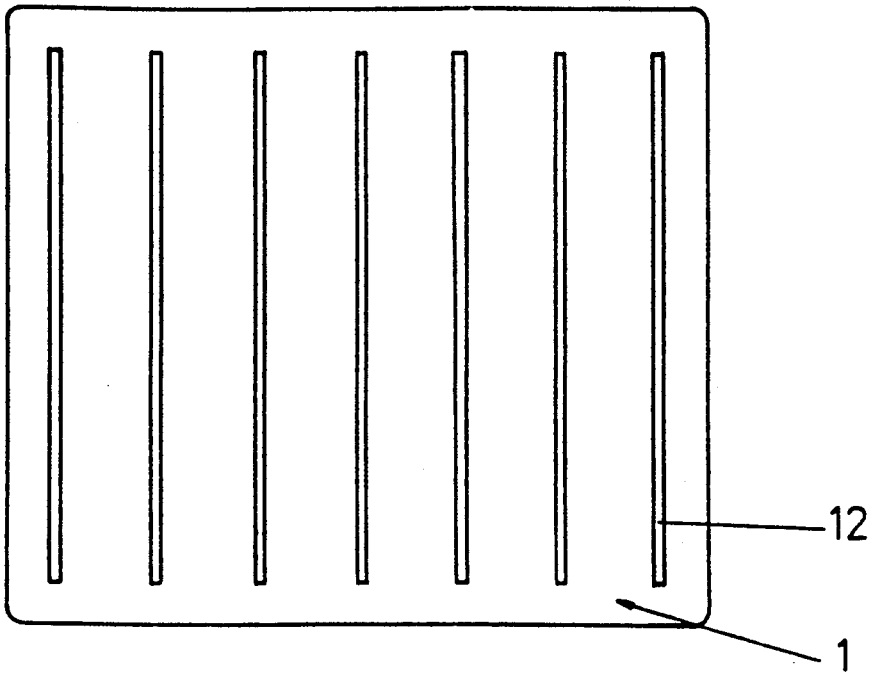
FIG. 6 is a top view of the base according to the present invention.
Figure 7:
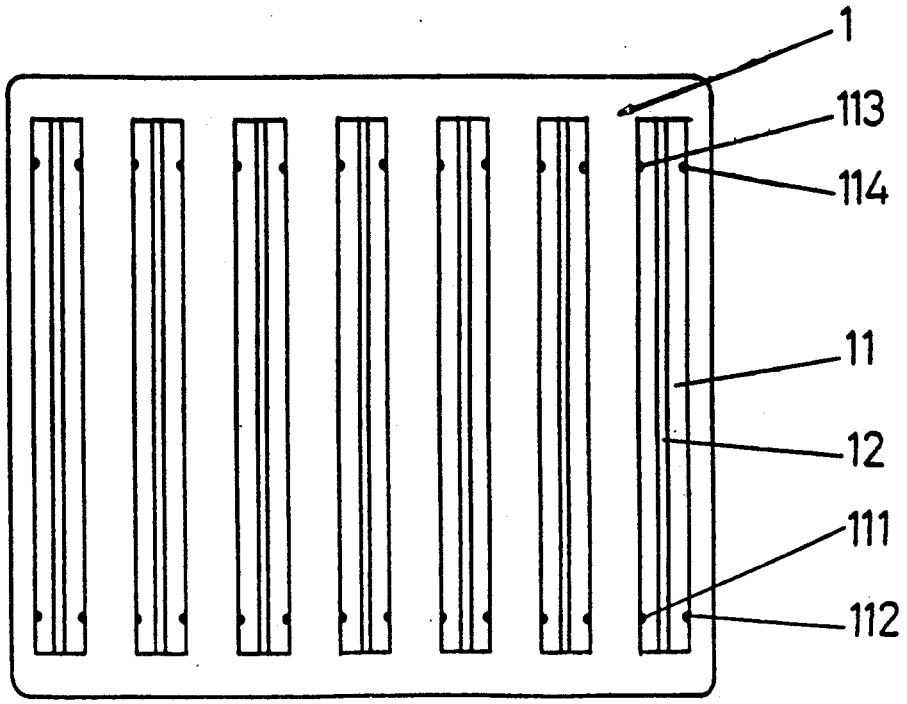
FIG. 7 is a bottom view of the base according to the present invention.

Referring to FIGS. 1, 2 and 3, the present invention is composed of a base (1) and a plurality of partitions (2). As shown in FIGS. 6 and 7, the base (1) is designed with a plurality of dovetail slots (11). Each dovetail slot (11) has two positioning tabs (111 and 113) on one side and another two positioning tabs (112 and 114) on the opposite side, and a longitudinal groove (12) in the middle. The number of dovetail slots (11) and longitudinal grooves (12) depend on the size of the file holder designed according to the present invention. The base (1) according to the present invention has a flat top surface with a plurality of longitudinal grooves (12).

Figure 4:
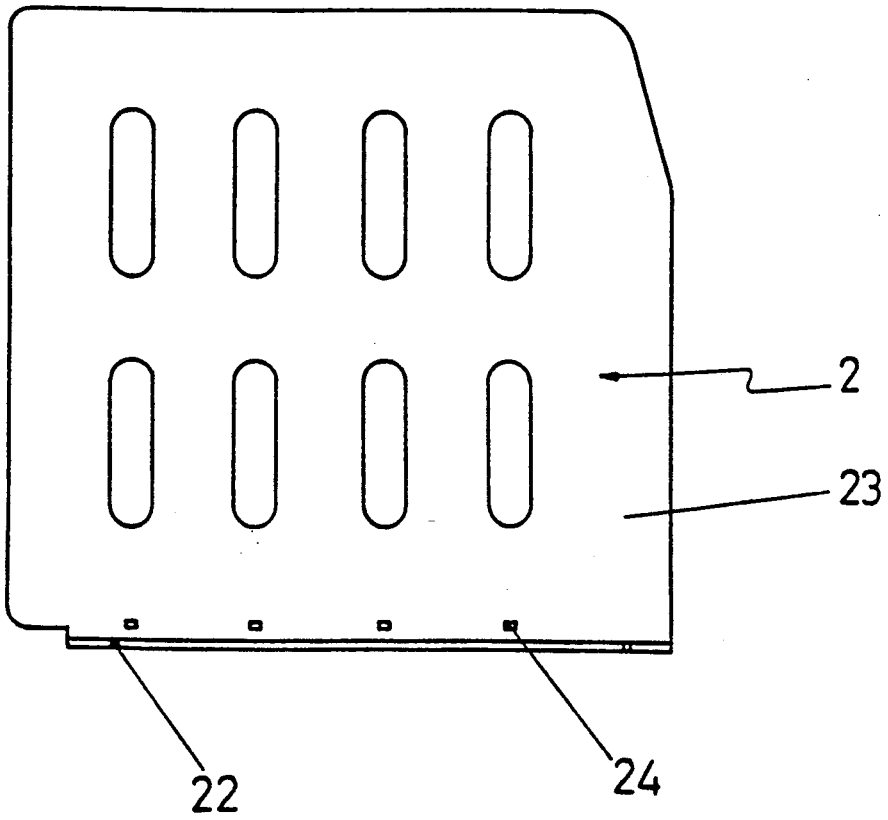
FIG. 4 is a side view of the partition according to the present invention.

Please refer to FIGS. 1, 3 and 4 for design of the partition (2) according to the present invention. The partition (2) can be designed in any shape to meet different requirements, and is mainly characterized by a design of positioning notches (22) at appropriate positions on two opposite sides of a footing plate (21) on the bottom of the partition (2), and a plurality of positioning blocks (24) at appropriate intervals on an vertical board (23) which is perpendicular to the footing plate (21).

Figure 5:
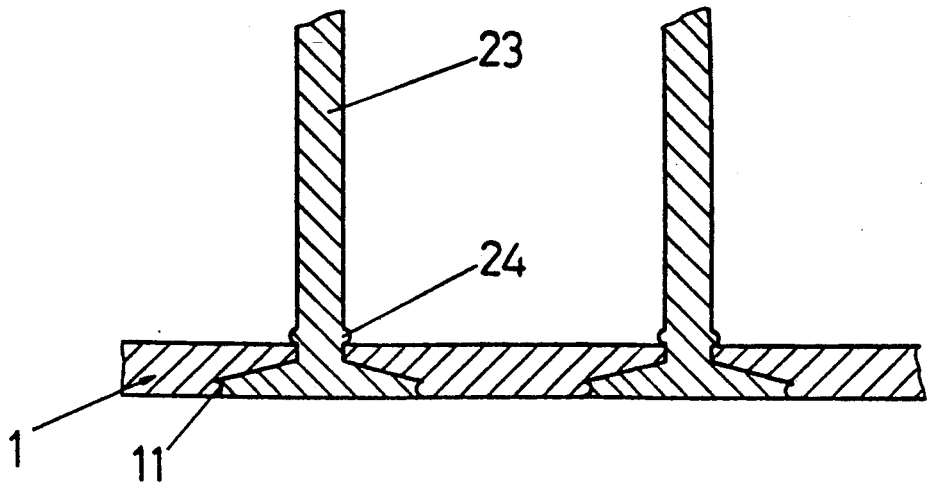
FIG. 5 is a sectional view of the partition and the base after assembly according to the present invention.

Please refer to FIGS. 1 and 5, the footing board (23) is in the form of a wedge-shaped part for fitting to the dovetail slot (11) of the base (1) so that the positioning blocks are seized and consequently the vertical board (23) is fixed on the base (1). A complete assembly of the file holder according to the present invention is shown in FIG. 1. The positioning tabs (111, 112, 113 and 114) as well as the positioning notches (22) can be designed in any appropriate position to facilitate placing of documents.

I claim:

1. A super-thin type file holder comprising a base in the form of a board having a plurality of spaced dovetail slots, each having a longitudinal groove in the middle and a plurality of positioning tabs along both sides of the dovetail slot; and a plurality of partitions each composed of an elongate footing board having a plurality of longitudinally spaced positioning notches on each side thereof and a vertical board having a plurality of spaced positioning blocks;

characterized by fitting of the respective partitions to the base by fitting respective footing boards within respective dovetail slots in such a manner that respective positioning tabs are received within corresponding notches and said positioning blocks engage said base.

2. A super-thin type file holder as claimed in claim 1 wherein the positioning notches on each partition and the positioning tabs at the base geometrically conform to each other for fitting purposes.

3. A super-thin type file holder as claimed in claim 1 wherein the footing board of the partition geometrically conforms to the shape of the dovetail slot of the base, and so that the footing board can be fitted to the dovetail slot with the positioning tabs within said notches.

* * * * *